US005988990A

United States Patent [19]

Lee

[11] Patent Number: 5,988,990

[45] Date of Patent: Nov. 23, 1999

[54] APPARATUS FOR SEPARATING LUBRICATING OIL FROM REFRIGERANT IN A HERMETIC COMPRESSOR

[75] Inventor: Sung-Tae Lee, Suwon, Rep. of Korea

[73] Assignee: Samsung Electronics Co., Ltd., Suwon, Japan

[21] Appl. No.: 08/974,976

[22] Filed: Nov. 20, 1997

[30] Foreign Application Priority Data

Feb. 24, 1997 [KR] Rep. of Korea ..... 97-5502

[51] Int. Cl.[6] ..... F04B 39/04

[52] U.S. Cl. ..... 417/312; 417/313; 417/902; 181/403

[58] Field of Search ..... 417/312, 313, 417/902; 181/403

[56] References Cited

U.S. PATENT DOCUMENTS 3,689,203 9/1972 Vaughn ..... 417/371

5,733,107 3/1998 Ikeda ..... 417/312

5,888,055 3/1999 Lee ..... 417/312

*Primary Examiner*—Timothy S. Thorpe

*Assistant Examiner*—Ehud Gartenberg

*Attorney, Agent, or Firm*—Burns, Doane, Swecker & Mathis, L.L.P.

[57] ABSTRACT

A hermetically sealed compressor includes a cylinder forming a compression chamber, and a piston reciprocally mounted in the cylinder for compressing gaseous refrigerant. A mixture of gaseous refrigerant and lubricating oil is conducted via a conduit arrangement to a suction muffler located upstream of the compression chamber. The conduit arrangement includes, at an inlet to the suction muffler, radially inner and outer tubes forming a channel therebetween. Gaseous refrigerant flows into the suction muffler through the inner tube. Lubricating oil traveling radially outwardly of the gaseous refrigerant enters the channel and is discharged from a downstream end of channel and thus does not enter the suction muffler.

8 Claims, 7 Drawing Sheets

APPARATUS FOR SEPARATING LUBRICATING OIL FROM REFRIGERANT IN A HERMETIC COMPRESSOR

BACKGROUND OF THE INVENTION

1. Field of the Invention

The present invention relates to hermetic compressors, more particularly, to an apparatus for separating lubricating oil from a mixture of gaseous refrigerant and oil in hermetic compressors.

2. Description of the Related Art

In general, hermetic compressors include a hermetic body which encloses a motor unit and a compressing unit. The hermetic compressor compresses a gaseous refrigerant input from an evaporator. At this time, the gaseous refrigerant changes its state from high temperature and low pressure into high temperature and high pressure. The compressed refrigerant, i.e., the refrigerant having a high temperature and a high pressure is discharged out of the compressor.

As shown in FIGS. 1 through 3, such a hermetic compressor includes a hermetic body 100 in which a motor unit 110 and a compressing unit 120 are installed at respective upper and lower portions thereof. The motor unit 110 enables the compressing unit 120 to suck-in a refrigerant, to compress the sucked-in refrigerant, and to discharge the compressed refrigerant.

The motor unit 110 includes a stator 111 and a rotor 112 which rotates depending on an electromagnetic relation with the stator 111. A crankshaft 113 is press-fitted in a through hole of the rotor 112.

The compressing unit 120 includes a cylinder 123 that provides a chamber for compressing the refrigerant input through a suction tube 121. A piston 124 is reciprocated in the cylinder 123 by the rotation of the crankshaft 113. A cylinder head 125 closes an end of the cylinder 123. Between the cylinder 123 and the cylinder head 125, a valve unit including a suction reed valve (not shown), a valve plate 126 and a discharge reed valve 127 is inserted. The suction reed valve, the valve plate 126 and the discharge reed valve 127 are used for respectively admitting refrigerant into the cylinder 123 and discharging the refrigerant out of the cylinder 123 after the refrigerant is compressed.

When power is supplied to the motor unit 110, the crankshaft 113 is rotated thereby to reciprocate the piston 124 in the cylinder 123. As a result, steps of sucking, compressing and discharging the refrigerant are carried out.

As shown in FIGS. 1 and 3, a refrigerant travels through the suction tube 121, a suction muffler 122, a suction chamber 125*a* of the cylinder head 125, and a suction hole 126*a* of the valve plate 126, successively. The refrigerant is then compressed by the piston 124.

Thereafter, the compressed refrigerant is passed through a discharge hole 126*b* and pushes open the discharge reed valve 127. The refrigerant is then discharged out of the body 100 through a discharge chamber 125*b* of the cylinder head 125, and a discharge tube 128, successively.

Generally, in a refrigeration cycle using such a compressor, a lubrication oil is mixed with the liquid refrigerant in order to lubricate mechanically removable parts. During the cycle, the mixture is passed through the evaporator wherein the liquid refrigerant, having a low temperature and a low pressure, is changed into a gaseous refrigerant. Thereafter the gaseous refrigerant is fed into the compressor. However, the lubrication oil contained in the refrigerant is still in its liquid state and is fed into the cylinder 123 of the compressor.

In other words, as shown in FIG. 3, the lubrication oil fed through the suction tube 121 together with the refrigerant is sucked along the internal side of a connecting spring 129 into the suction muffler 122. The sucked refrigeration oil is fed into the cylinder 123 through the valve 126 and is discharged through the valve 127.

However, the oil fed into the cylinder 123 of the compressor may reduce the efficiency of suction, compression and discharge of the gaseous refrigerant. This may result in a reduced refrigeration capacity of machineries using the compressors.

In addition, oversupply of the oil through the valves 126 and 127 may cause a valve unit failure.

SUMMARY OF THE INVENTION

It is therefore an object of the present invention to provide an apparatus for separating lubricating oil from a refrigerant when the refrigerant and the oil contained in the refrigerant are conducted toward a cylinder of a hermetic compressor.

The invention pertains to a hermetic compressor comprising a cylinder forming a compressing chamber having gas inlet and outlet openings; a piston reciprocally mounted in the cylinder for compressing gas in the chamber; a motor for reciprocating the pistons; and a conducting structure connected to the inlet opening for conducting a mixture of gaseous refrigerant and liquid oil, and for separating the oil from the refrigerant. The conducting structure includes a suction muffler having an inlet port, and a conduit arrangement connected to the inlet port. The conduit arrangement includes an outer tube for conducting the mixture with at least most of the liquid oil travelling radially outside of the gaseous refrigerant. An inner tube is disposed at an end of the outer tube and communicates with the inlet port for conducting thereto gaseous refrigerant received from the outer tube. The inner tube is spaced radially inwardly of the outer tube for forming a channel therebetween. The channel includes an open upstream end for receiving liquid oil from the outer tube, whereby the inner tube separates gaseous refrigerant from liquid oil. The channel includes an oil discharge opening disposed downstream of the upstream end of the channel for discharging liquid oil from the channel.

BRIEF DESCRIPTION OF THE DRAWINGS

The above object and other advantages of the present invention will become more apparent by describing in detail the preferred embodiment thereof with reference to the attached drawings, in which.

DETAILED DESCRIPTION OF THE PREFERRED EMBODIMENTS

Figure 1:
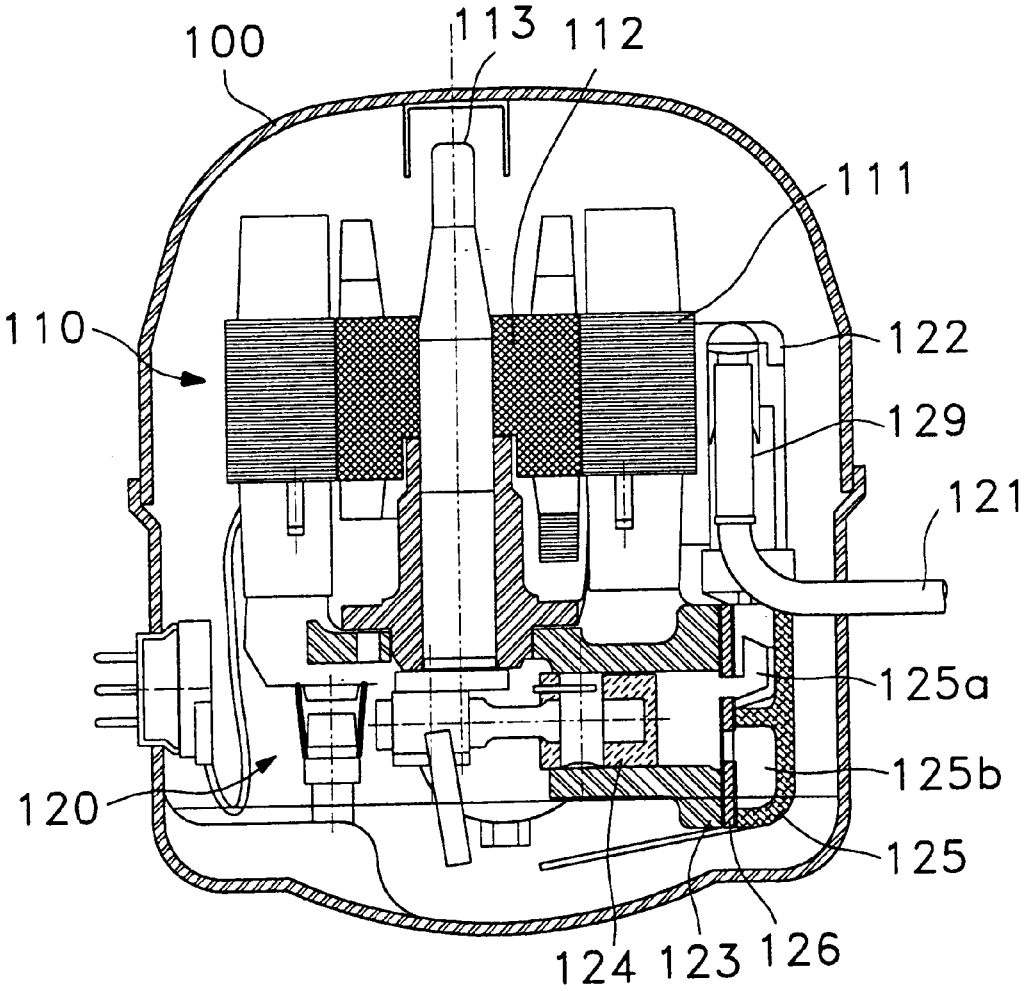
Fig. 1 PRIOR ART
FIG. 1 is a cross-sectional view of a conventional hermetic compressor.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the elements are exaggerated for clarity.

Figure 2:
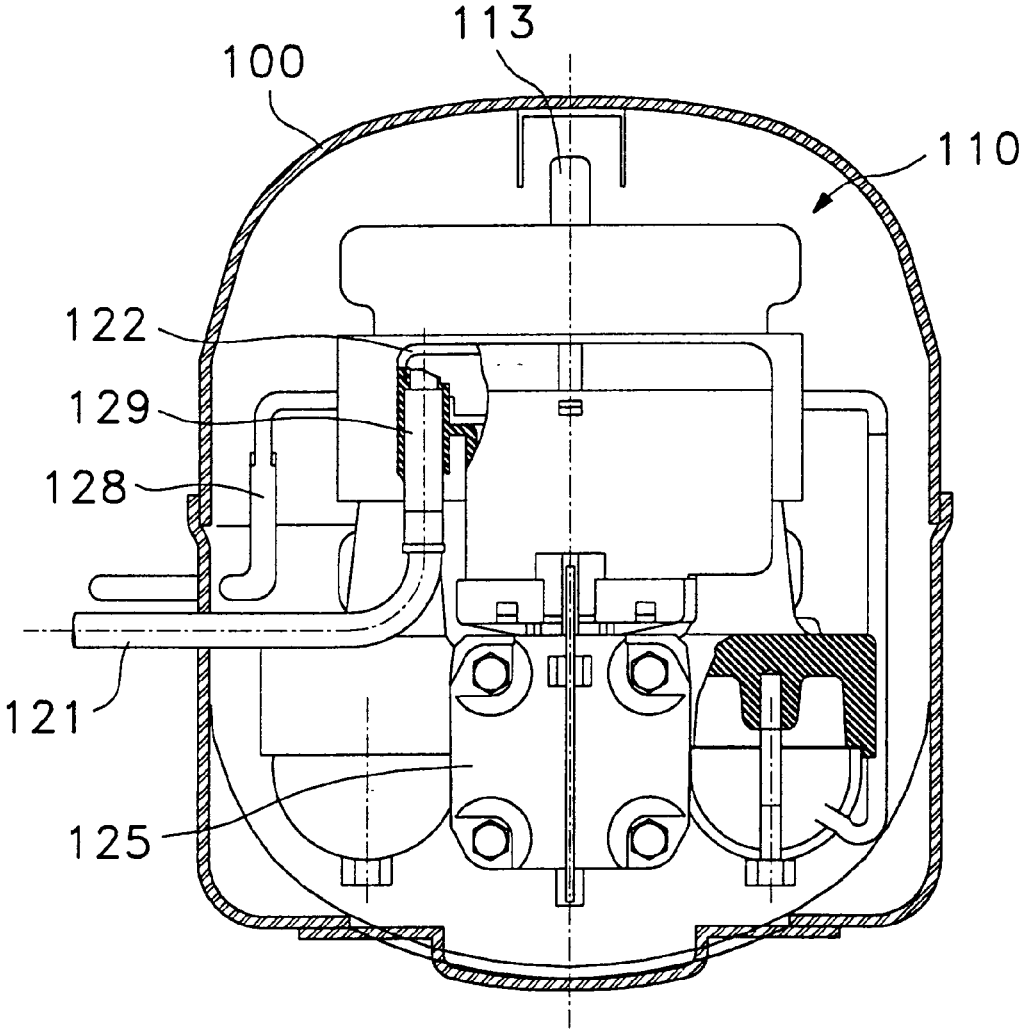
Fig. 2 PRIOR ART
FIG. 2 is a cross-sectional view of the conventional hermetic compressor of FIG. 1 when rotated by 90°.
Figure 3:
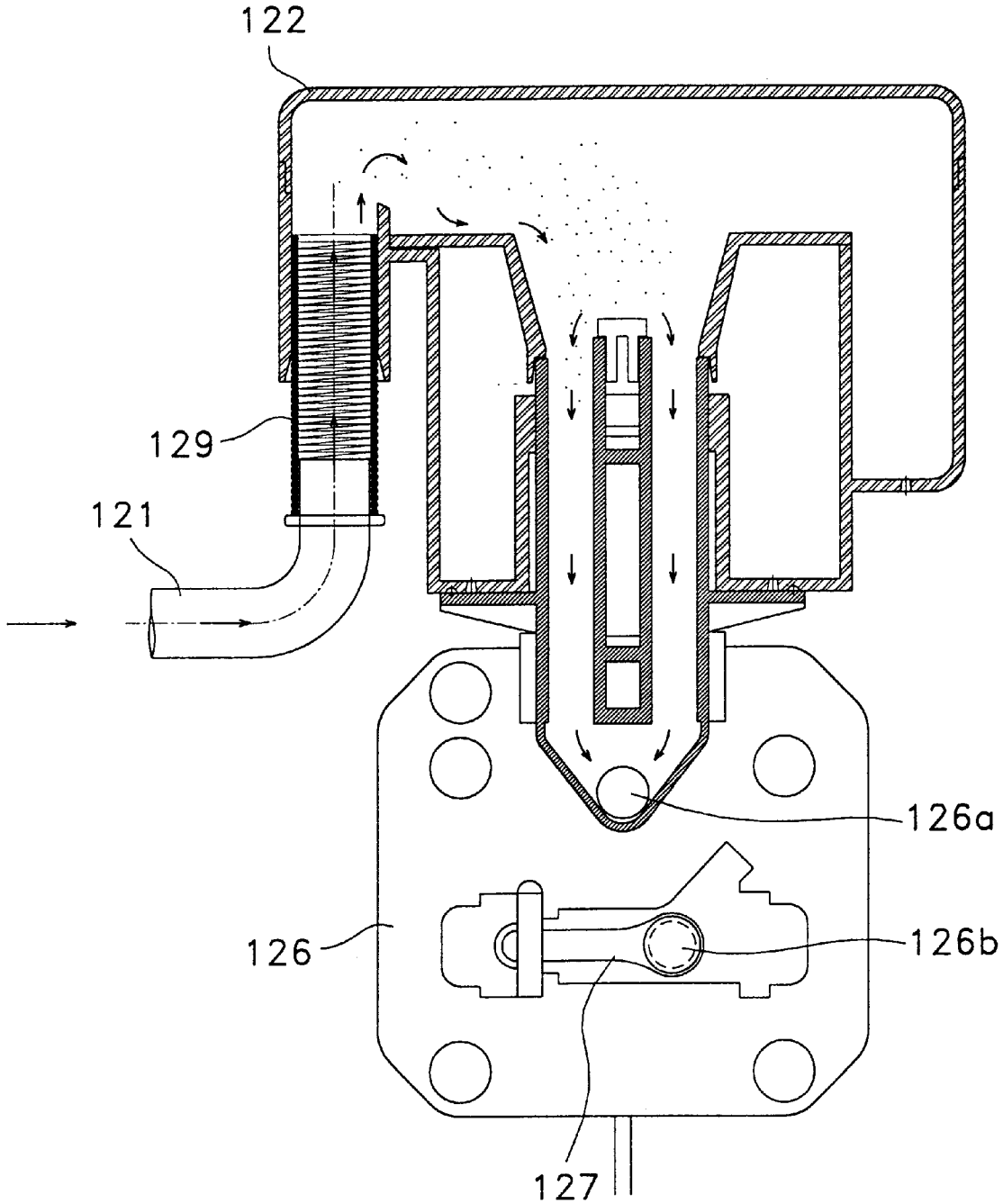
Fig. 3 PRIOR ART
FIG. 3 illustrates flow of a refrigerant and oil through a suction tube and a suction muffler into a conventional hermetic compressor.

As a conventional hermetic compressor described referring to FIGS. 1 and 2, the hermetic compressor according to the present invention includes a hermetic body 100 which encloses a motor unit 110 and a compressing unit 120 which are respectively arranged on an upper and a lower portion thereof. The compressor is connected within a refrigeration cycle in which there is circulated a mixture of refrigerant and lubrication oil. The motor unit 110 enables the compressing unit 120 to suck-in, compress and discharge the refrigerant. The motor unit 110 includes a stator 111 and a rotor 112. The rotor 112 rotates depending on an electric relation with the stator 111. A crankshaft 113 is press-fitted in a through hole of the rotor 112. The compressing unit 120 includes a cylinder 123 providing a compression chamber for compressing the refrigerant input through a suction tube 121 which constitutes a portion of a conduit structure conducting a refrigerant. A piston 124 is reciprocated in the cylinder 123 by the rotation of the crankshaft 113. A cylinder head 125 closes an end of the cylinder 123. Between the cylinder 123 and the cylinder head 125, a valve unit including a suction reed valve (not shown) covering an inlet opening of the compression chamber, a valve plate 126 and a discharge reed valve 127 is inserted. The valve plate 126 and the discharge reed valve 127 are respectively used for admitting refrigerant into the cylinder 123 and discharging compressed refrigerant out of the cylinder 123.

An apparatus for separating lubrication oil from the refrigerant according to the present invention includes an oil separating tube 130 disposed between the suction tube 121 and an inlet port P of the suction muffler 122. The tube 130 forms part of the conduit structure.

The separating tube 130 has a smaller diameter than the suction tube 121 such that mainly only the gaseous refrigerant 140 flows through a flow passage formed by the separating tube 130, and the lubrication oil 150 flows into an upstream end of a channel C formed between an inner surface of the tube 121 (which defines an outer channel wall) and the outer surface of the tube 130 (which defines an inner channel wall).

A rubber packing 131 is mounted on the outer circumference of the separating tube 130 and prevents the oil 150 flowing along the outer circumference of the separating tube 130 from entering the suction muffler 122.

Furthermore, oil discharge holes 121*a* are formed in the upper portion of the suction tube 121 downstream of the upstream end of the channel C. The oil 150 whose travel is blocked by the rubber packing 131 is discharged through the oil discharge holes 121*a* of the suction tube 121.

Figure 4:
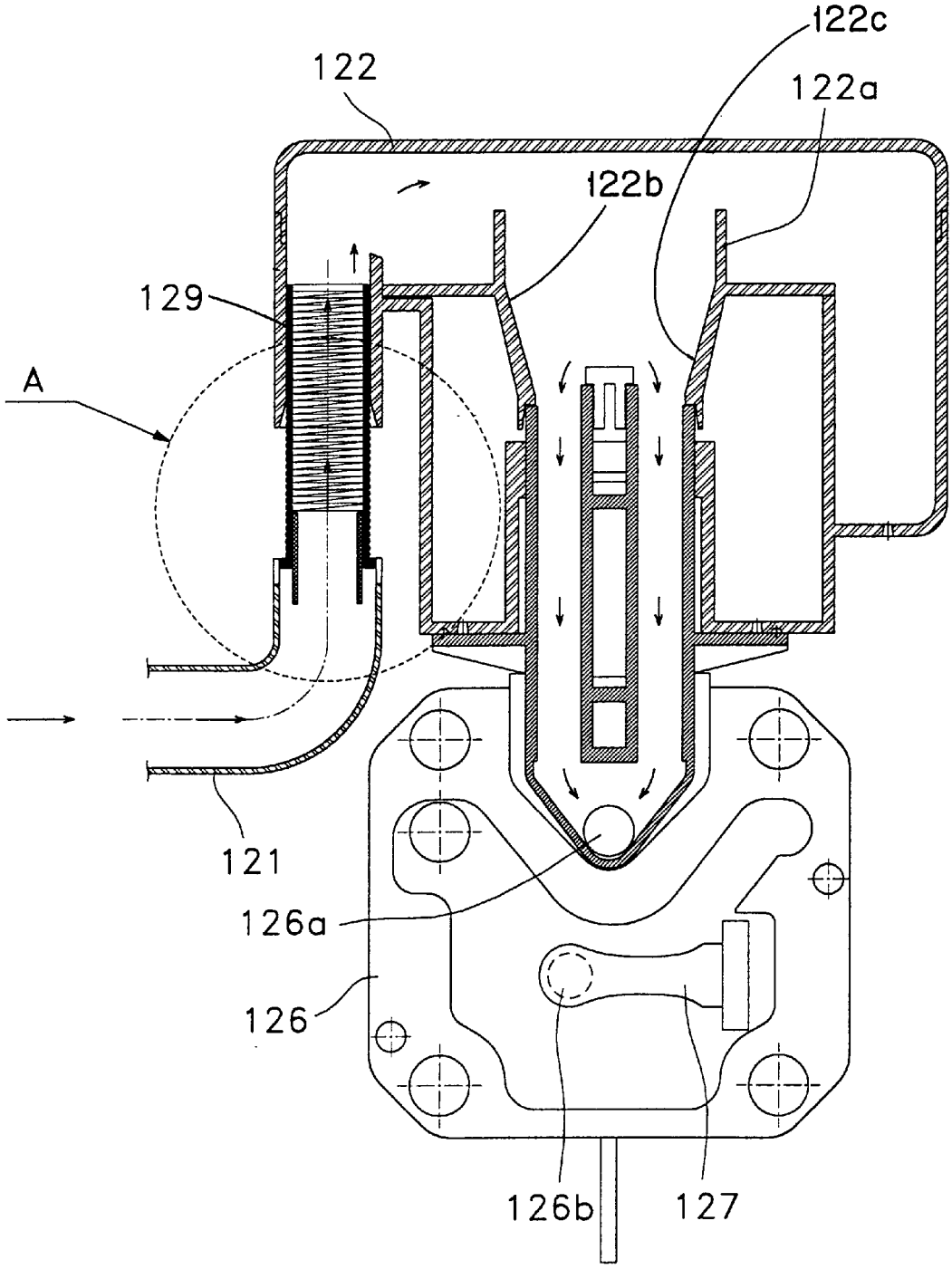
FIG. 4 illustrates flow of a refrigerant and oil through a suction tube and a suction muffler into a hermetic compressor according to a first embodiment of the present invention.
Figure 5:
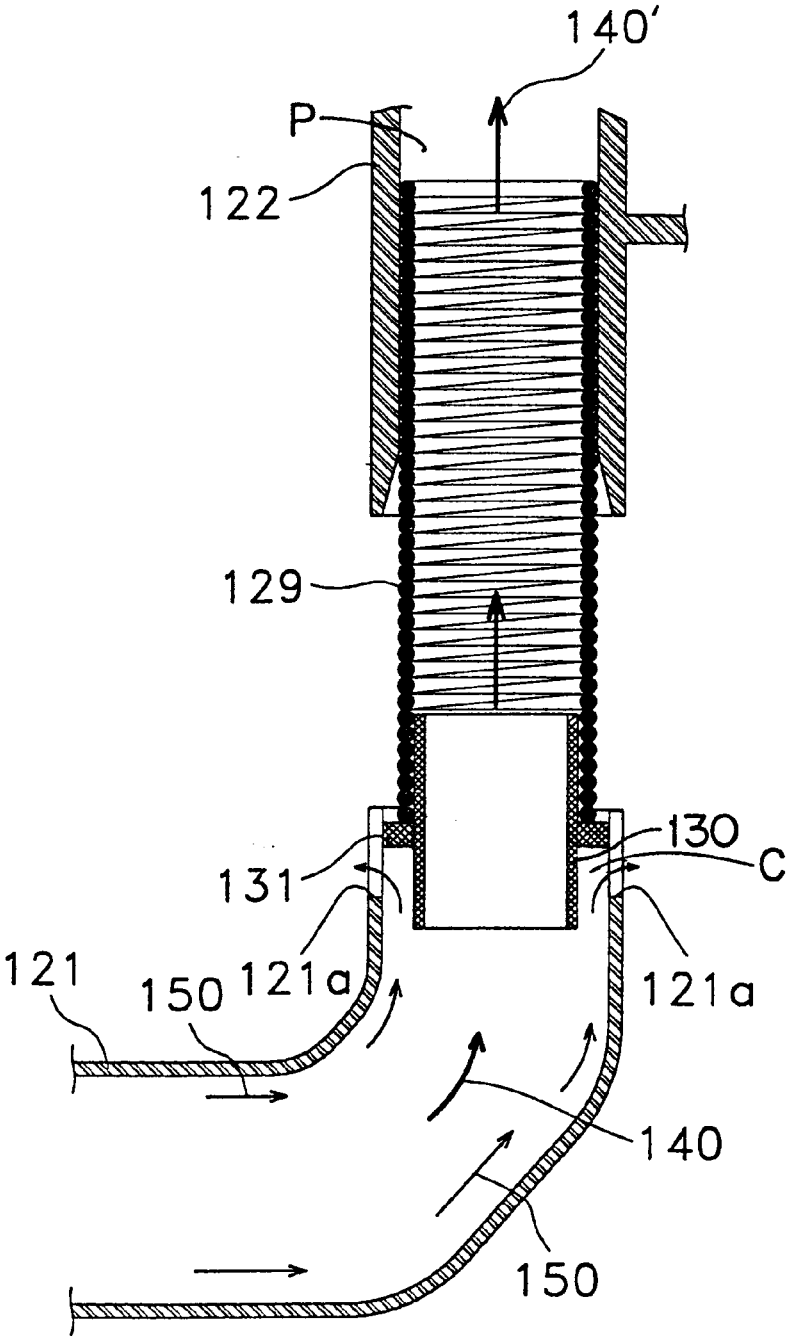
FIG. 5 is an enlarged cross-sectional view of a portion A of FIG. 4.
Figure 6:
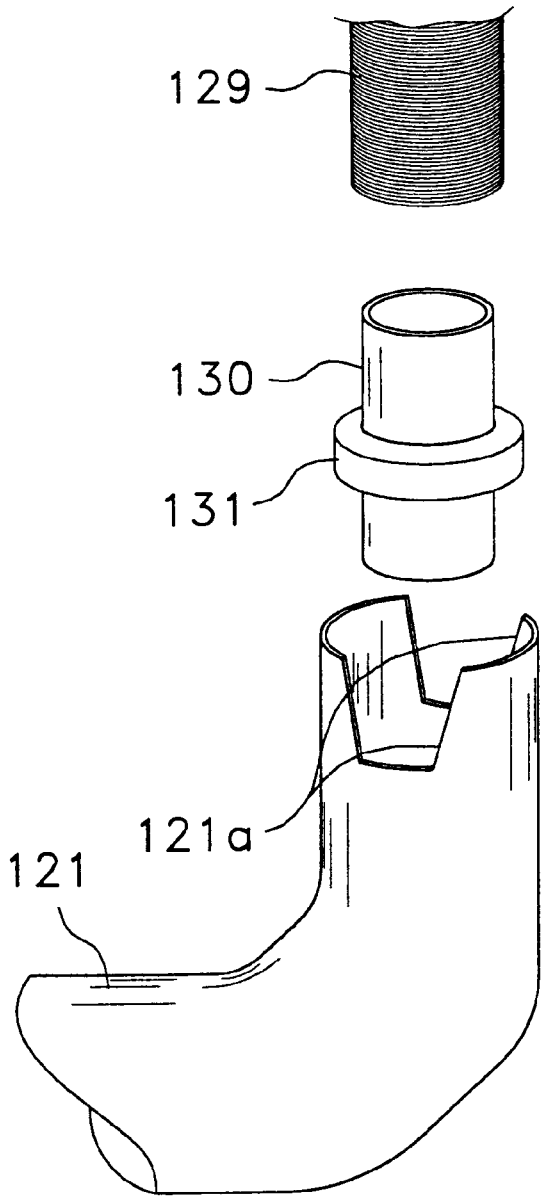
FIG. 6 is an exploded view of FIG. 5.

The suction muffler 122 includes an oil cut-off wall 122*a* (see FIG. 4) which surrounds and rises above an entrance 122*b* of a vertically oriented refrigerant-conducting passage 122*c*. That wall 122*a* prevents any oil 150 that may have passed through the separating tube 130, from reaching a suction hole 126*a* of the valve plate 126.

The operation of the apparatus for separating lubrication oil from a refrigerant of the hermetic compressor according to the first preferred embodiment of the present invention will be described hereinafter.

When the motor unit 110 is supplied with power, the crankshaft 113 is rotated. The crankshaft 113 reciprocates the piston 124 in the cylinder 123. As a result, steps of sucking, compressing and discharging of the refrigerant are carried out.

A refrigerant 140 that is heat-exchanged in an evaporator through a refrigeration cycle, is sucked through the suction tube 121 of the compressor. At this time, the refrigerant 140 is in its gaseous state having a high temperature and a low pressure.

Since lubrication oil 150 that is contained in the refrigerant 140 and sucked through the suction tube 121 together with the refrigerant 140 is in a liquid state, it flows along the inner circumference of the suction tube 121 and is discharged through the oil discharge holes 121*a* formed on the upper edge portion of the suction tube 121.

Refrigerant 140' from which the oil 150 has been removed in the above mentioned manner, is passed through the separating tube 130 and fed into the suction muffler 122.

Oil that travels along the outer surface of the separating tube 130 is blocked by the rubber packing 131 from entering the suction muffler 122. That oil then travels along the rubber packing 131 and is discharged through the oil discharge holes 121*a*.

As aforementioned, the present invention provides that mainly only the refrigerant 140' from which the oil has been separated, enters the suction muffler 122. The refrigerant 140' entering the suction muffler 122 is passed through the suction hole 126*a* of the valve plate 126. Any oil 150 that may have passed through the separating tube 130 is prevented from entering the cylinder 123 through the suction hole 126*a* of the valve plate 126 by the oil cut-off wall 122*a* of the suction muffler 122.

The refrigerant 140' passed through the suction hole 126*a* of the valve plate 126 is delivered into the cylinder 123 and compressed by the piston 124. The compressed refrigerant 140' having a high temperature and a high pressure is discharged out of the compressor past the discharge reed valve 127 and discharge tube 128. Thereafter, the refrigerant 140' is introduced into a condenser.

Figure 7:
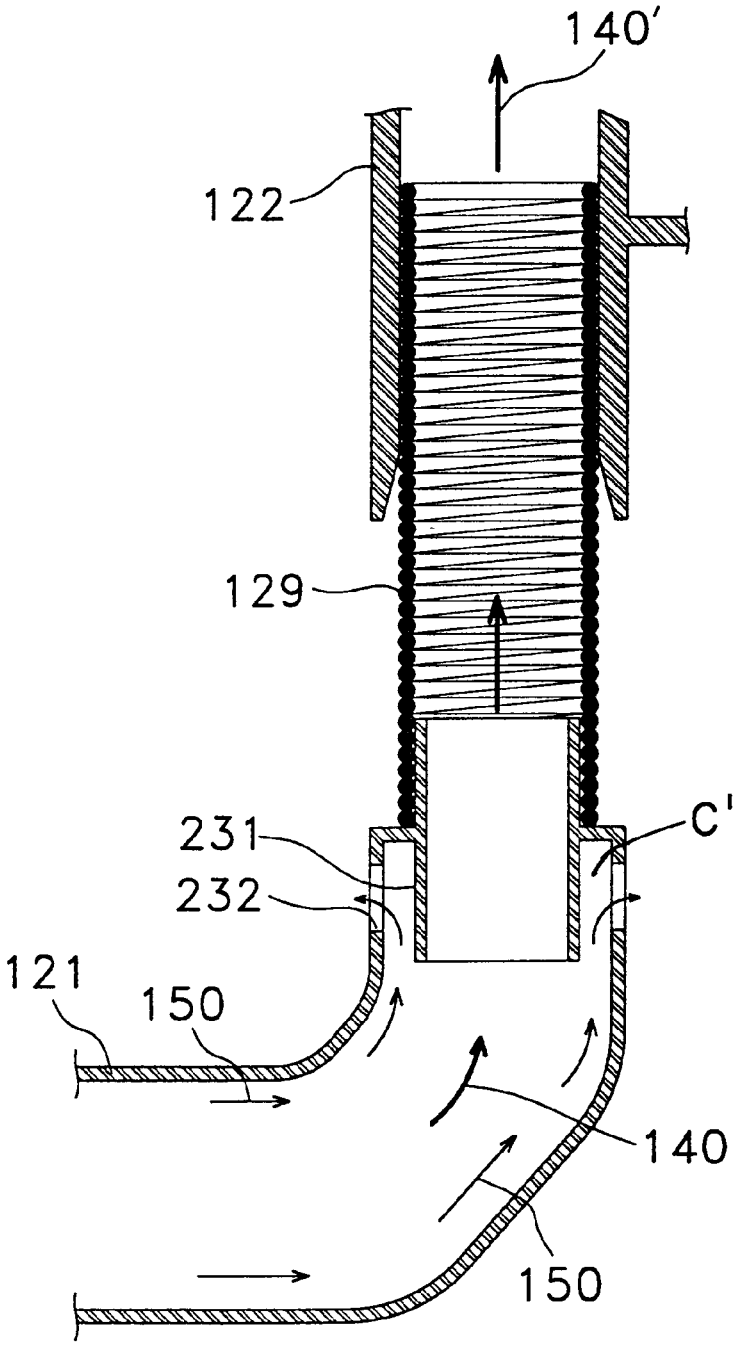
FIG. 7 illustrates flow of a refrigerant and oil through a suction tube and a suction muffler into a hermetic compressor according to another embodiment of the present invention.

FIG. 7 shows an apparatus for separating from a refrigerant according to another embodiment of the present invention. As shown in FIG. 7, a refrigerant passage tube 231 having a smaller diameter than the suction tube 121 is formed integrally of one piece with the suction tube 121, so that pure refrigerant 140' can be passed through the refrigerant passage tube 231 into the suction muffler 122. The oil 150 flowing along the inner circumference of the suction tube 121 can be discharged out of the suction tube 121 through discharge holes 232 formed on the upper edge portion of the suction tube 121.

The operation of the oil separating apparatus according to the second embodiment of the present invention is as follows. First, a refrigerant/oil mixture 140 is sucked through the suction tube 121. Pure refrigerant 140' of the sucked mixture 140 is conducted into the suction muffler 122 through the refrigerant passage tube 231. The oil 150 flowing along the inner circumference of the suction tube 121 is discharged out of the suction tube 121 through the oil discharging holes 232. Thus, the oil 150 is separated from the mixture 140.

As aforementioned, the present invention is capable of separating, from the refrigerant, oil that may cause a degradation of the efficiency of the hermetic compressor.

Accordingly, the efficiency of the hermetic compressor and the evaporative latent heat of the evaporator are enhanced. This results in an improved freezing performance.

This invention has been described above with reference to the aforementioned embodiments. It is evident, however, that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A hermetic compressor, comprising:

a cylinder forming a compressing chamber having gas inlet and outlet openings;

a piston reciprocally mounted in the cylinder for compressing gas in the chamber;

a motor for reciprocating the piston; and a conducting structure connected to the inlet opening for conducting a mixture of gaseous refrigerant and liquid oil, and for separating the oil from the refrigerant, the conducting structure including:

a suction muffler having an inlet port, and a conduit arrangement connected to the inlet port, the conduit arrangement including an outer tube for conducting the mixture with at least most of the liquid oil traveling radially outside of the gaseous refrigerant, an inner tube being disposed at an end of the outer tube and communicating with the inlet port for conducting thereto gaseous refrigerant received from the outer tube, the inner tube being spaced radially inwardly of the outer tube for forming a channel including an open upstream end for receiving liquid oil from the outer tube, whereby the inner tube separates gaseous refrigerant from liquid oil, the channel including an oil discharge opening disposed downstream of the upstream end of the channel for discharging liquid oil from the channel.

2. The hermetic compressor according to claim 1 further including packing disposed at a downstream end of the channel for blocking a flow of oil into the suction muffler.

3. The hermetic compressor according to claim 2 wherein the suction muffler includes an upwardly open passage disposed downstream of the inlet port, a vertical wall surrounding an inlet of the vertical passage to prevent liquid oil from entering the passage.

4. The hermetic compressor according to claim 1 wherein the inner and outer tubes are of integral one-piece construction with one another.

5. The hermetic compressor according to claim 4, wherein the suction muffler includes an upwardly open passage disposed downstream of the inlet port, a vertical wall surrounding an inlet of the vertical passage to prevent liquid oil from entering the passage.

6. The hermetic compressor according to claim 1 wherein the suction muffler includes an upwardly open passage disposed downstream of the inlet port, a vertical wall surrounding an inlet of the vertical passage to prevent liquid oil from entering the passage.

7. The hermetic compressor according to claim 1 wherein there is a plurality of the oil discharge openings.

8. The hermetic compressor according to claim 1 wherein the inlet port faces in a vertically downward direction.

* * * * *